US007481921B2

(12) United States Patent
Kent

(10) Patent No.: US 7,481,921 B2
(45) Date of Patent: Jan. 27, 2009

(54) INLET FILTER FOR STORM DRAIN

(75) Inventor: Michael E. Kent, Columbus, IN (US)

(73) Assignee: Earth Support Systems, Columbus, IN (US)

( * ) Notice: Subject to any disclaimer, the term of this patent is extended or adjusted under 35 U.S.C. 154(b) by 0 days.

(21) Appl. No.: 11/426,634

(22) Filed: Jun. 27, 2006

(65) Prior Publication Data

US 2007/0295652 A1 Dec. 27, 2007

(51) Int. Cl.
*E03F 5/06* (2006.01)

(52) U.S. Cl. ..... 210/164; 210/170.03; 210/496; 210/504; 210/505; 210/508; 404/4

(58) Field of Classification Search ..... 210/163, 210/164, 170.03, 496, 504, 505, 506, 508; 404/4, 5
See application file for complete search history.

(56) References Cited

U.S. PATENT DOCUMENTS 3,003,643 A * 10/1961 Thomas ..... 210/508
4,708,792 A * 11/1987 Takarabe et al. ..... 210/505
5,167,579 A 12/1992 Rotter
5,242,591 A 9/1993 Beechert et al.
5,425,672 A 6/1995 Rotter
5,579,549 A 12/1996 Selman et al.
5,587,072 A 12/1996 Regan
5,632,888 A 5/1997 Chinn et al.
5,776,567 A 7/1998 Schilling et al.
5,904,842 A 5/1999 Billias et al.
5,958,226 A 9/1999 Fleischmann
6,015,489 A 1/2000 Allen et al.
6,267,252 B1 * 7/2001 Amsler ..... 210/505
6,334,953 B1 1/2002 Singleton
6,343,985 B1 2/2002 Smith
6,358,405 B1 3/2002 Leahy
6,368,017 B2 4/2002 Black
6,531,059 B1 3/2003 Morris et al.
6,537,446 B1 3/2003 Sanguinetti
6,609,852 B2 8/2003 Wimberger
6,640,490 B1 * 11/2003 Boehringer ..... 47/9
6,666,974 B2 12/2003 Page
6,869,526 B2 3/2005 Sharpless
6,932,911 B1 8/2005 Groth et al.

(Continued)

FOREIGN PATENT DOCUMENTS

JP 6-193124 * 7/1994

*Primary Examiner*—Christopher Upton
(74) *Attorney, Agent, or Firm*—Woodard, Emhardt, Moriarty, McNett & Henry LLP

(57) ABSTRACT

Embodiments of a filtration device, kit and method related to filtration in storm water systems are disclosed. A filtering device generally includes a mat adapted to filter water flowing through an inlet. The mat may have a top with a mesh cover, a main filtering portion and a bottom. The main filtering portion is formed of randomly-aligned fibers and a binding agent which impart a porosity that allows water to flow through generally unimpeded while sediment is filtered by the mat. A filtration kit is provided which could include the mat or other filtering device, a plurality of attachment members and a plurality of disks which allow for securing of the attachment members. Filtration device and kit are generally easy to install and clean, durable, less expensive than competing systems, and reusable.

14 Claims, 7 Drawing Sheets

U.S. PATENT DOCUMENTS

| | | | | |
|---|---|---|---|---|
| 7,097,768 | B2 * | 8/2006 | Talbot et al. | 210/505 |
| 2001/0023842 | A1 | 9/2001 | Singleton | |
| 2002/0014445 | A1 * | 2/2002 | Cardwell et al. | 210/163 |
| 2002/0130070 | A1 | 9/2002 | Roesner | |
| 2002/0130083 | A1 * | 9/2002 | Middleton et al. | 210/163 |
| 2002/0131826 | A1 * | 9/2002 | Spangler et al. | 405/302.4 |
| 2003/0136719 | A1 | 7/2003 | Allard | |
| 2004/0099589 | A1 * | 5/2004 | Terry, III | 210/150 |
| 2004/0200767 | A1 * | 10/2004 | Singleton | 210/163 |
| 2005/0161407 | A1 * | 7/2005 | McPhillips | 210/170 |
| 2005/0199558 | A1 | 9/2005 | Jensen | |
| 2006/0070294 | A1 * | 4/2006 | Spittle | 47/9 |
| 2006/0096910 | A1 | 5/2006 | Brownstein et al. | |
| 2007/0095747 | A1 * | 5/2007 | Theisen et al. | 210/504 |

* cited by examiner

INLET FILTER FOR STORM DRAIN

BACKGROUND

The present invention relates to a filtration device and method finding particular utility in reducing the amount of silt, sedimentation and debris in water entering storm drains.

In response to tighter guidelines imposed by the federal Environmental Protection Agency under the Clean Water Act, additional regulatory attention is being focused on controlling silt and sediment found in storm, construction site and other sources of water runoff. Federal and state agencies have issued mandates and developed guidelines regarding the prevention of non-point source pollution. These mandates affect water runoff from storms, construction sites, and other sources. Such laws and regulations have a significant impact on not only how runoff water may be channeled and diverted, but also on, for example, the ways that contractors can dispose of excess or unwanted water from constructions sites. With respect to construction sites, the Environmental Protection Agency (EPA) has a goal of having developers prevent eighty percent of general contaminants, such as unwanted, site-generated sediment, from entering inlet drains.

One of the drawbacks to existing filtering devices is that silt, sedimentation, mud and other debris can build up quickly, causing filtering devices to clog. As clogging begins, water flow decreases, which leads to a back-up of excess, unfiltered water. Back-ups may create additional regulatory, environmental, aesthetic and structural problems. Many systems have circumvented back-up of excess water by providing by-pass overflow features; however, while an overflow feature solves the immediate problem, the overflow water remains unfiltered, thereby defeating the primary intent of the filtration device.

When a filtering device's capacity is reduced to the point that it no longer adequately functions, the filter must be removed and either be disposed of or cleaned. Filtration devices can be difficult and time consuming to remove. For example, when a filtration device is attached to the underside of an inlet grate, sediment is collected underneath the grate. To change or clean a filter, the inlet grate must first be removed. Next, either the device must be removed (to be cleaned or disposed of) or the sediment must be removed from the device. Removal of the device can be difficult, as it may have a large mass of sediment that is very heavy. In this case, removal is at least taxing and time-consuming, possibly cumbersome and may require lifting machinery. If the device does not hold a large volume of sediment, then removal will be more easily accomplished, but also must be done more frequently. In addition to the constraints and problems associated with cleaning or changing a filtering device, timing also creates a problem. Oftentimes, clogging of filtering devices occurs during periods of heavy water flow, such as seasonal or other flooding periods. This presents an immediate need for cleaning or replacing a filter coupled with circumstances that make the task even more difficult, onerous, and time-consuming.

Accordingly, there exists a need for better devices, systems and methods for filtering sediment from water entering storm drains, specifically those which provide ease of installation; can be easily cleaned or changed, even during periodic flooding; prevent unwanted back-up of excess water; filter nearly all or all of the water that comes through the inlet; and are cost effective.

SUMMARY OF THE INVENTION

This disclosure relates to embodiments of a filtration device for use in a storm water system. The device generally includes a mat adapted to filter water flowing through an inlet, such as a storm inlet. The mat has a top with a mesh cover, a main filtering portion and a bottom. The main filtering portion is formed of randomly-aligned fiber and a binding agent which impart a porosity that allows water to flow through generally unimpeded while sediment is filtered by the mat.

The disclosure further provides for a filtration kit. The kit could include the mat discussed above or a different filtration device, a plurality of attachment members and a plurality of disks which allow for securing of a filtration device. The filtration device is generally secured to an inlet grate.

A further embodiment includes a method of installing the filtration device. This includes placing the mat at least partially over an inlet grate. An attachment member or multiple attachment members are then threaded through at least a portion of the mat, around a rung in an inlet grate and back through at least a portion of the mat. Finally, the attachment members are secured.

DESCRIPTION OF THE PREFERRED EMBODIMENTS

Figure 1:
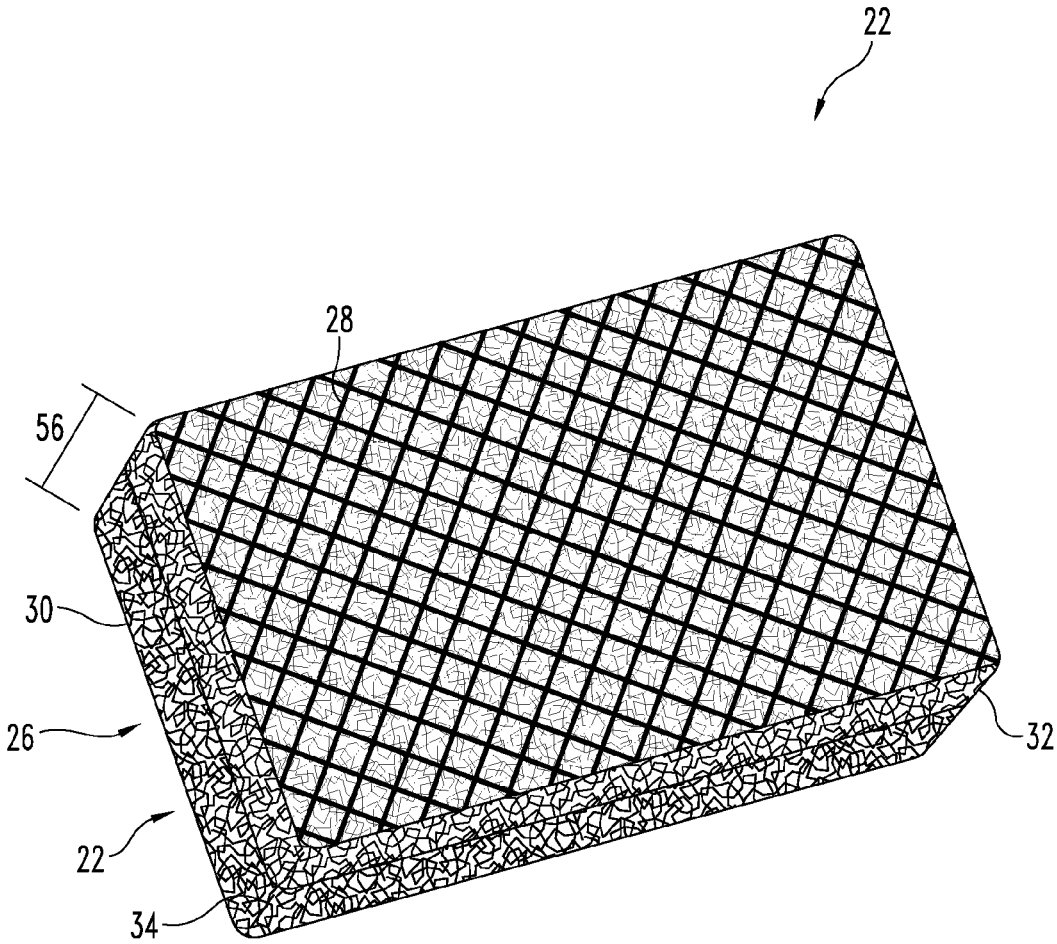
FIG. 1 is a perspective view of an embodiment of a mat of a filtering device.

For the purposes of promoting an understanding of the principles of the disclosure, reference will now be made to the embodiment illustrated in the drawings and specific language will be used to describe the same. It will nevertheless be understood that no limitation of the scope of the claims is thereby intended, such alterations and further modifications in the illustrated device, and such further applications of the principles of the disclosure as illustrated therein being contemplated as would normally occur to one skilled in the art to which the disclosure relates.

Figure 2:
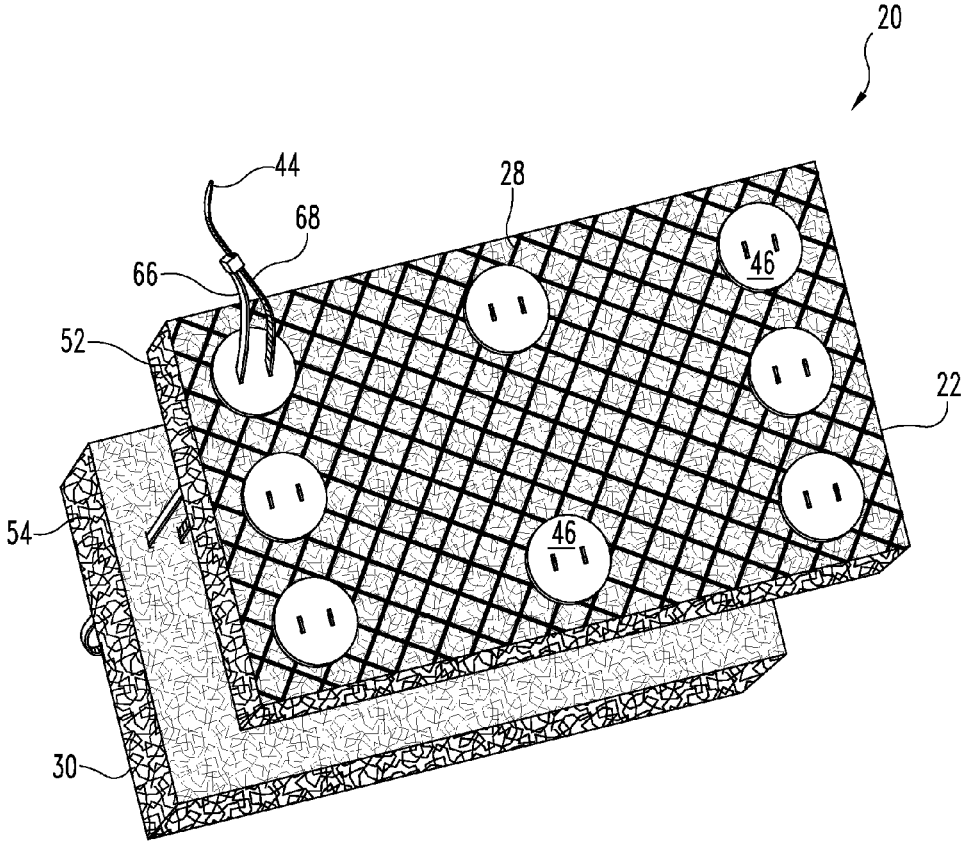
FIG. 2 is an exploded perspective view, additionally including disks and a threaded attachment member, of the embodiment shown in FIG. 1.
Figure 5:
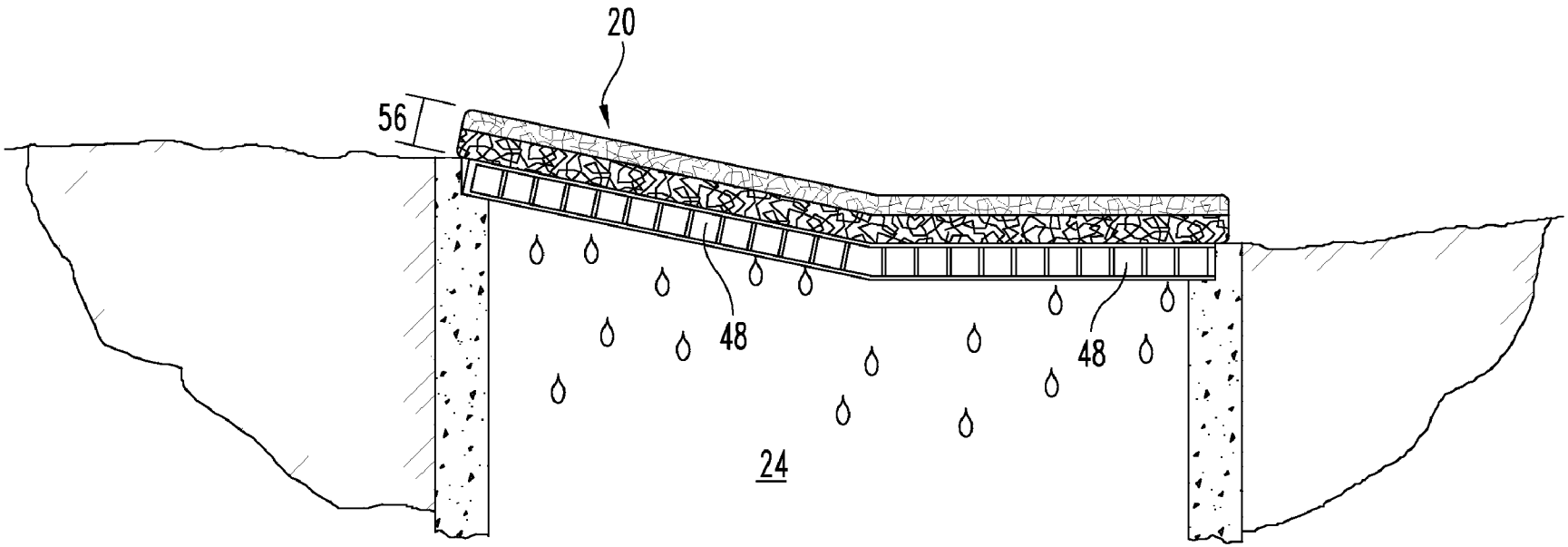
FIG. 5 is a side view in cross-section showing an embodiment of the filtering device in use over an inlet.

Referring generally to the figures, an embodiment of a filtering device 20 for use in a storm water system is shown. Filtering device 20 may include a mat 22, attachment members 44, and disks 46 (FIG. 2). Mat 22 is adapted to filter water flowing through an inlet 24 (FIG. 5). Mat 22 may have a main filtering portion 26, a top 28, a bottom 30, and sides 32 (FIG. 1). Portion 26 is composed of randomly-aligned fibers 34 which may be periodically affixed to one another by a binding agent 36. Portion 26 has a porosity which allows water to flow through mat 22 generally unimpeded, while sediment and other contaminants 40 remain trapped at sides 32 or top 28 of mat 22 or within mat 22. Top 28 may be composed of a scrim, or a thin open mesh backing, which is adjacent to, and preferably affixed to, portion 26. Bottom 30 may also have a scrim (not shown). In a preferred embodiment, filtering device 20 (FIG. 2) includes attachment members 44 and disks 46 and they are provided in equal numbers.

Top 28 of mat 22 generally is a thin layer of scrim which provides a first-pass, broad filter for device 20. Top 28 is generally affixed, chemically, mechanically or otherwise, to portion 26. Top 28 may provide a scaffold upon which randomly-aligned fibers 34 are attached, thereby also giving structural integrity to mat 22. As shown, top 28 is a scrim or a loose, mesh weave with roughly perpendicular threads, creating the appearance of a "square" weave. Top 28 can be made from natural or synthetic materials. Preferred embodiments use a synthetic material, such as polyester, as it is durable and cost effective. Top 28, when in the form of a scrim, may range in thickness from two to twenty mils. Five to fifteen mils are more preferred, with the most preferably thickness being 10 mils. Of course, weave could have alternate appearances, such as triangular or polygonal. Additionally, top 28 may be thick or thin, more densely woven or less densely woven, and provided as a single mesh layer or a plurality of mesh layers, depending upon the conditions that would best suit a particular location for use of filtering device 20. Bottom 30, if present, is structurally similar to top 28. It may also be in the form of a scrim which provides structural support, similarly to top 28.

Figure 4:
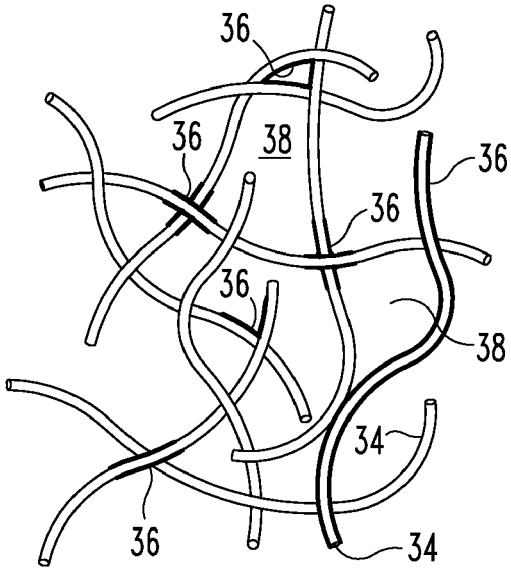
FIG. 4 is a fragmentary, enlarged view of the main filtering portion of the embodiment of the device shown in FIG. 1.

Main filtering portion 26 is generally formed from a non-woven web consisting of a plurality of randomly oriented and interconnected fibers 34. Portion 26 provides adequate resistance to compression so as to furnish a sound structural base, and generally resists degradation from sunlight and damage from vermin. Portion 26 has open spaces 38 between fibers 34 (FIG. 4), thus creating a porosity that allows for favorable water flow, while preventing sediment 40 from passing through portion 26.

Fibers 34 may be from a natural or synthetic origin. In a preferred embodiment, fibers are natural, more preferably coir, or coconut husk, fibers. Fibers 34 may be blended with additional components to attain an optimal level of sediment filtering capacity. In a preferred embodiment, fibers 34 are blended with sterilized animal hair. Fibers 34 may then be treated with a binding agent 36. Preferred binding agents 36 include water-based phenolics or latexes, with latex being a more preferred agent. If present, binding agent 36 affixes a certain percentage of the fibers 34 to one another. Preferred percentages of binding agent to weight of fibers include 45% to 65%, with 50% to 60% being more preferred. Binding agent 36 may be located at periodic or random intervals on fibers 34, or each fiber 34 could be coated with binding agent 36, such that fiber 34 would provide an inner core, while binding agent 36 would provide an outer surface.

Main filtering portion 26 may be made in the following manner, though this description is not meant to be limiting, as portion 26 may be made in an alternate manner. A bale of material is opened via mechanical or pneumatic processing and then blended with additional materials, if desired. Next, the material is randomly aligned into a web, generally by airflow using a web forming machine, such as a Rando-Webber component. The material may be randomly aligned onto a mesh fabric, such as a scrim of top 28. The raw fiber web may then be sprayed with binding agents and oven-cured to bind the fibers into a relatively fixed arrangement. In a preferred embodiment, coir fibers are opened, blended with sterilized animal hair, randomly aligned onto top 26, sprayed with a water-based latex binding agent 36, and then cured. While not intending to be bound by any theory, this particular combination is thought to create portion 26 with moderate hydrophobic properties, thereby aiding in the filtration of water, as water is somewhat "repelled" from fibers 34 and sediment 40 is trapped. Furthermore, coir is thought to be a naturally durable and long-lasting material; fiber 34 longevity and rigidity may be even further increased when coated with latex binding agent 36. Thus, the best mode of filtering device 20 is thought to provide far superior filtration, durability, and longevity over the products currently available. For example, a preferred embodiment of mat 22 passed a bench-scale sediment retention device characterization test at a flow of 50 L, with sediment of 0.15 kg and a maximum particle size of 2 mm, capturing 59.1% of sediment.

Portion 26 may be composed of multiple layers. In one preferred embodiment, as shown in FIGS. 1 and 2, portion 26 is composed of upper layer 52 and lower layer 54, with upper layer 52 functioning as a secondary filter and lower layer 54 functioning as a primary filter. In this embodiment, upper layer 52 is more rigid than lower layer 54. As such, it can provide increased durability for filtering device 20. For example, upper layer 52 can be power washed, power blown, hosed down or even driven over. Additionally, an industrial street sweeper can "clean" it and filtering device 20 will continue to function. Although the illustrated upper and lower layer embodiment has been found to be the most useful, it is contemplated that portion 26 could have alternate forms, such as a single layer or more than two layers. Additionally, portion 26 could have a layer or multiple layers with variable densities.

The density of portion 26 aids in establishing its filtration and water flow capacity. The primary filter of portion 26, such as lower layer 54, has a density between 3 oz./sq. ft. and 4.5 oz./sq. ft., preferably a density between 3 oz./sq. ft. and 4 oz./sq. ft. Highly preferred embodiments have a density of between 3.25 oz./sq. ft. and 3.75 oz./sq. ft., with the most preferred density being 3.5 oz./sq. ft. The secondary filter of portion 26, such as upper layer 52, may have a density between 4 oz./sq. ft. and 6 oz./sq. ft., preferably a density between 4.25 oz./sq. ft. and 5.75 oz./sq. ft, and still more preferably a density between 4.5 oz./sq. ft. and 5.5 oz./sq. ft. Highly preferred embodiments have a density of between 4.75 oz./sq. ft. and 5.25 oz./sq. ft., with the most preferred density being 5 oz./sq. ft.

Portion 26 may be fabricated in many heights and/or thicknesses 56. Generally, the thickness 56 at which filtration is maximized and interference with routine occurrences is minimized is sought. Of course, that point may vary widely depending upon the individual circumstances of use. Considerations such as volume of traffic, volume of water flow, season, amount of sediment in general area, position of inlet and others may influence the ideal height for a specific use. Generally, height 56 will range between one and four inches. For most circumstances, a height 56 of portion 26 between one and a half and three inches will be most adequately balance competing needs; two inches is a general use preferred height 56. Additionally, when portion 26 is composed of more than one layer, consideration will be given to the ratio of the layers to achieve a desired height 56. In the illustrated embodiment, where portion includes upper layer 52 and lower layer 54, the preferred ratio of upper layer 52 to lower layer 54 is between 1:1 and 1:2.25, a more preferred ratio is between 1:1.25 and 1:2, a still more preferred ratio is between 1:1.4 and 1:1.8, while the most preferred ratio is approximately 1:1.67. In embodiments where additional layers are present, the primary filtering layer (lower layer 54 in the illustrated embodiment) should generally constitute at least one half of the height 56.

Mat 22 may be sized to fit a variety of specific configurations of inlet 24. Such sizing may be done on site. For example, mat 22 may be cut to fit the general dimensions of inlet 24. Additionally, if a larger mat is needed, multiple mats 22 could be abutted and attached to one another, for example, using attachment members 44. As a result of this, mat 22 may be any variety of shapes, as differing shapes will allow it to accommodate different inlets. Mat 22 may be circular or oval and thus have a single, continuous side 32 or it may be square, rectangular or otherwise polygonal and have multiple sides 32. Additionally, grate 48 which generally covers inlet 24 may be flat, concave, convex or otherwise regularly or irregularly angled. Mat 22 is formed such that it can accommodate these variations. For example, if a grate 48 is concave, user may cut a V-shaped notch or series of notches in mat 22 and fit mat 22 to grate 48 accordingly. Mat 22 is particularly useful in inlet 24 configurations where there is (a) a right angle between inlet 24 and a curb 25 (FIG. 7), (b) an obtuse angle between inlet 24 and curb 25 (FIG. 8) and (c) mat 22 lies over a flat inlet 24.

Attachment members 44 and disks 46, which generally function to aid in attaching mat 22 to grate 48 of inlet 24, may be included as part of filtering device 20. One or more attachment members 44 may be used, depending on the location where the mat 22 will be used. In preferred embodiments, at least two attachment members 44 are used. Any whole number between two and twenty constitutes preferred numbers of attachment members 44. As shown in FIG. 2, attachment members 44 may pass through height 56 of mat 22, loop around a rung on grate 48 and come back through height 56 of mat 22. Attachment members 44 could have an alternate configuration, such as making an "S" or "L" through height 56 of mat 22, connecting to a rung on grate 48 and coming back through portion 26 and to top 28 of mat 22. It is also contemplated that attachment members 44 might come in from side 32 and therefore not transverse entire height 56 of portion 26. Attachment members 44 could also go through portion 26, attach to a rung of grate 48 and not reattach at top 28 of mat 22. In the illustrated embodiment, attachment members 44 are in the form of zip ties. Use of zip ties as attachment members 44 has been found to preserve the integrity of portion 26, thereby extending the longevity of mat 22. Other forms of attachment members 44 could also be used, such as, but not limited to, wire or rope.

Figure 3:
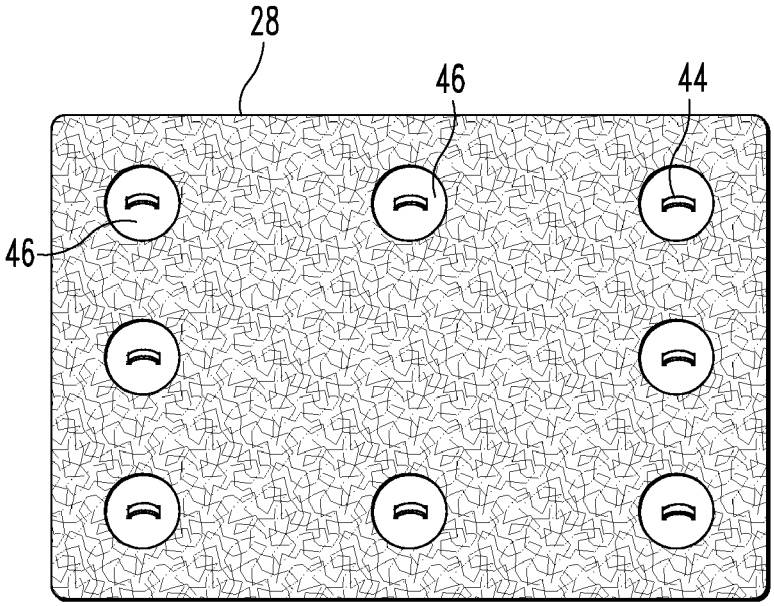
FIG. 3 is a top view of the embodiment shown in FIG. 2.
Figure 6:
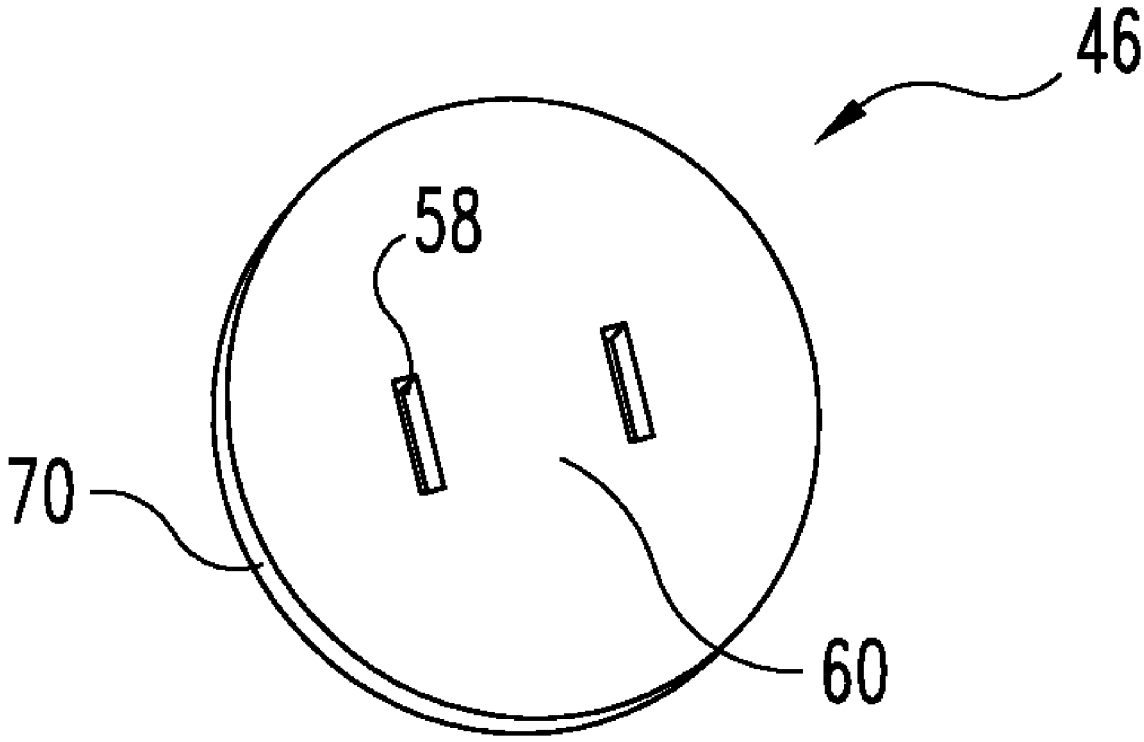
FIG. 6 is an enlarged perspective view of the disk shown in FIG. 2.

As seen in FIGS. 2 and 3, disks 46 are generally located adjacent top 28. Disks 46 function to stabilize attachment members 44 in embodiments where attachment members 44 are threaded through height 56 of portion 26, around a rung of grate 48 and back through height 56 to top 28 of mat 22. This has been found to be the most stable and secure method for attaching mat 22 to grate 48, and also causes the least degradation and disruption to the filtering capacity of mat 22. As illustrated in FIG. 6, disks 46 are preferably round, as this minimizes the area of top 28 that is not immediately accessible to flowing water and maximizes the distribution of downward force created at the site where first side 66 and second side 68 of attachment member 44 join. For most conventional uses, a round, thin disk 46 has been found to be optimal. In preferred embodiments, disk 46 has a diameter between 2.5 and 4.5 inches. In more preferred embodiments, the diameter is between 3 and 4 inches. Still more preferred is a diameter between 3.25 and 3.75 inches, with 3.5 inches being the most preferred diameter of disk 46. Disk 46 has a thickness 70, with preferred thicknesses ranging between 0.025 and 0.125 inches, with more preferable thicknesses being between 0.05 and 0.075 inches and the most preferable thickness being 0.06 inches. Alternatively, disks 46 could be square, oblong, rectangular or otherwise shaped. There may be situations where slightly concave or thicker disks 46 might be preferable.

Disks 46 may be made from natural or synthetic materials. Synthetic materials are preferred. Plastics and polymers are more preferred, with polyethylene being more preferred and high density polyethylene (HDPE) being most preferred. Disks 46 may contain an opening or slot or a plurality of openings or slots 58. These may be pre-cut, etched, or otherwise indicated. In a preferable embodiment, disks 46 contain two slots 58, with an adequate inter-slot space 60 to ensure the force from the attachment member 44 is disseminated. Slot could be round, square, rectangular or otherwise shaped. In a preferred embodiment, slot is rectangular. In some embodiments, disks 46 and attachment members 44 may further aid in holding portion 26, particularly upper layer 52 and lower layer 54, together.

Filtration device 20 may be placed externally on grate 48 of inlet 24. In a preferred orientation, device 20 covers the entire inlet 24. Device 20 may also be used to cover a portion of an inlet 24 or may cover area beyond inlet 24. When in use, device 20 is generally attached to grate 48. There may be situations where complete attachment is not necessary, such as if device 20 were to be wedged on enough of side or sides 32 that a portion of mat 22 would remain in place without being attached.

Figure 7:
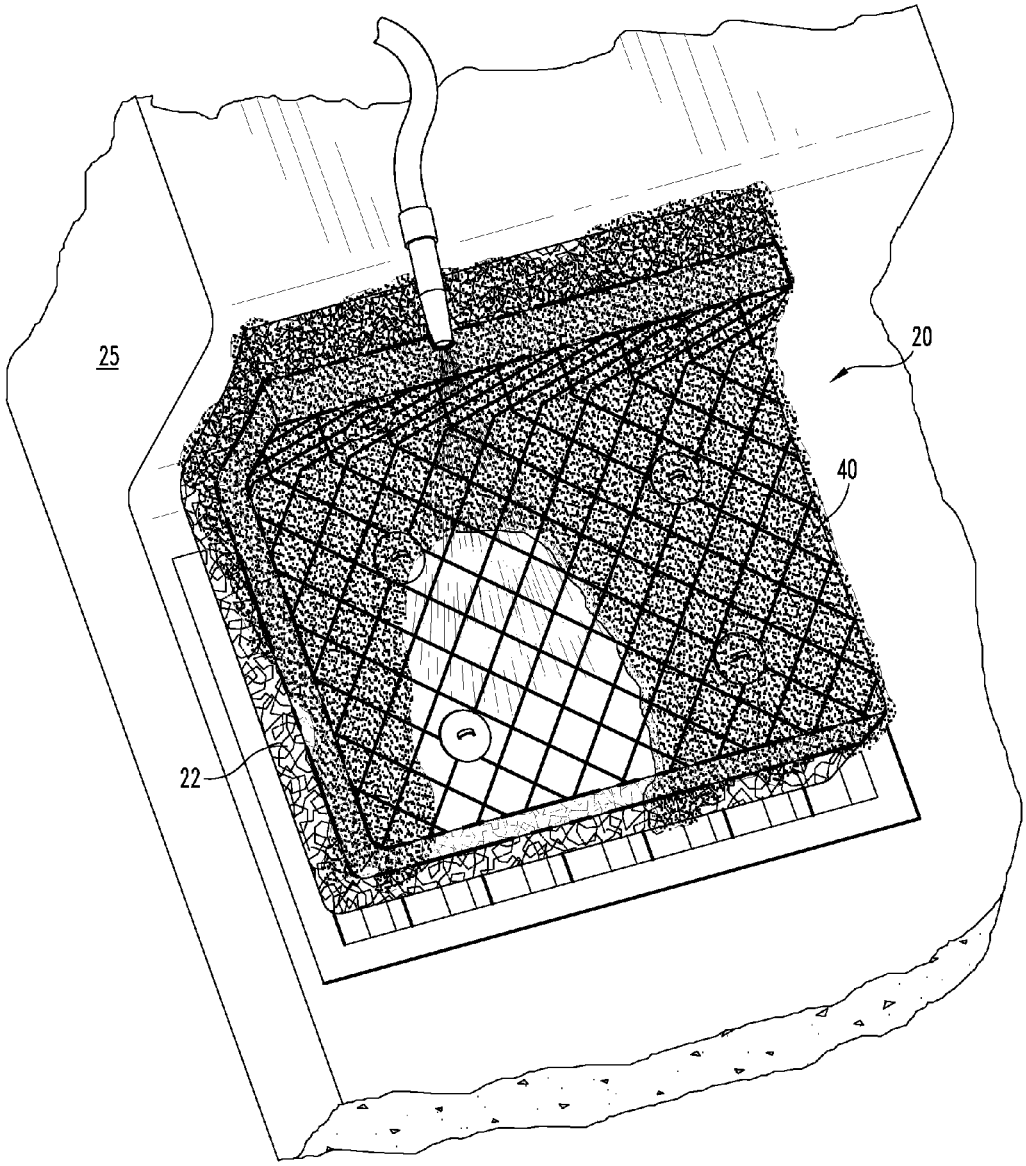
FIG. 7 is a perspective view embodiment of the filtering device shown in use on an inlet grate where there is a right angle between the curb and inlet grate.
Figure 8:
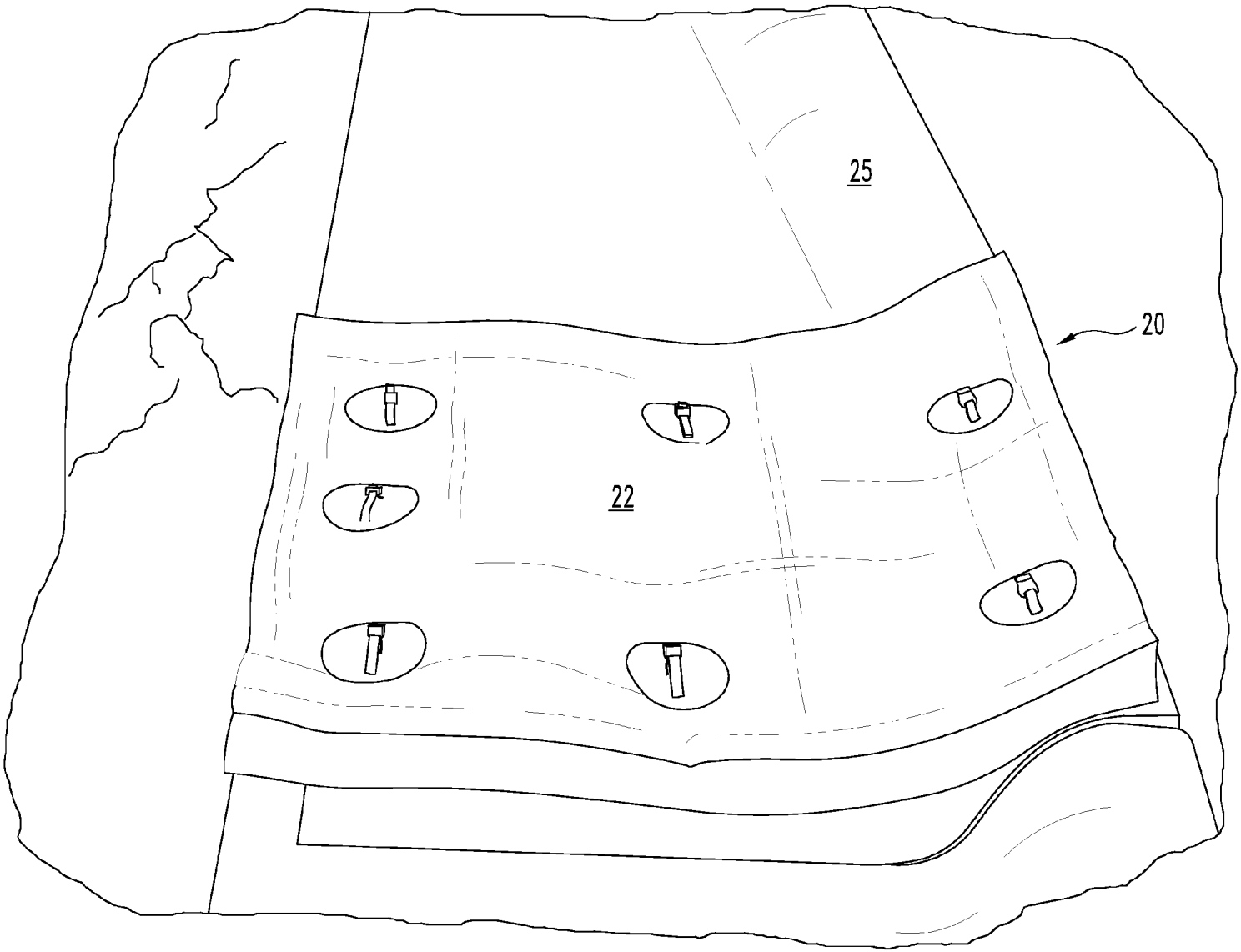
FIG. 8 is a perspective view of an embodiment of the filtering device illustrating an embodiment of the filtering device in use an inlet grate where there is an obtuse angle between the curb and the inlet grate.

After being placed, mat 22 generally functions in the following manner. Water, along with sediment 40, will generally flow into the side or sides 32 of mat 22. Some sediment 40 will remain trapped at side 32, while some will continue into mat 22. After mat 22 has been in use for a considerably length of time, or if intermittent flooding has occurred, sediment 40 will begin to block side 32 of mat 22. At this point, water will begin to flow over side 32 and on top 28 of mat 22. Some sediment 40 will remain trapped on top 28 of mat 22. At this point, filtration of water will proceed primarily through the height 56 of mat 22. Eventually, top 28 of mat 22 may become blocked with sediment 40, and cleaning will be necessary. To do this, top 28 of mat 22 can be swept, power washed, power blown or hosed down, as seen in FIG. 7. Mat 22 may be cleaned many times before replacement is necessary. Additionally, cleaning may become necessary during a time of continued water flow, such as a flood. Unlike other filtering devices, top 28 of mat 22 may be cleaned off while water is flowing and being filtered. In this situation, sediment would generally be removed from top 28 of mat power washing, using a tool, such as a shovel, or by hand. Once installed, mat 22 can be walked on, driven over, cycled over, street washed, or otherwise temporarily compressed and still maintain its structural integrity and function.

Device 20 may optionally be used internal, to, or underneath, grate 48 of inlet 24. To do so, grate 48 would be removed or dismounted and mat 22 would be attached, using attaching members 44 and disk 46, to grate 48. When used in this manner, water flows through top 28 and down height 56 of portion 26 of mat 22. When necessary, mat 22 can be cleaned, for example using a power washer or power blower, without removal of grate 48. Grate 48 need only be removed and mat 22 extricated when replacement of mat is required.

Device 20 may also be sold as a kit. The kit might include mat 22, attachment members 44, disks 46, a tool (not shown) for forming holes for placing attachment members 44 in mat 22, and instructions. Kit could include any of the variations and embodiments of device 20 described above, including variations of portion 26, attachment members 44, and disks 46.

While the illustrated embodiments have been detailed in the drawings and foregoing description, the same is to be considered as illustrative and not restrictive in character, it being understood that only the preferred embodiment has been shown and described and that all changes and modifications that come within the spirit of the invention are desired to be protected. The articles "a", "an", "said" and "the" are not limited to a singular element, and include one or more such elements.

I claim:

1. A storm water filtration system comprising:

an inlet grate and a filtration device; said filtration device contacting a portion of said inlet grate; said filtration device further comprising: a mat adapted to filter ground water said mat having a top, a bottom, at least a side, and a main filtering portion, said main filtering portion comprising randomly-aligned coir fibers and a latex binding agent, and having a density between 2.5 and 4.5 oz./sq. ft., wherein said density of said main filtering portion allows water to flow generally unimpeded through said main filtering portion while sediment is filtered, a portion of said sediment being filtered immediately upon contacting said main filtering portion and a portion of said sediment being filtered within said main filtering portion, whereby said filtration device may be cleaned and reused without removing said filtration device from said inlet grate.

2. The storm water filtration system of claim 1, wherein said filtration device is removably affixed to said inlet grate.

3. The storm water filtration system of claim 2, wherein said filtration device is positioned above said inlet grate.

4. The storm water filtration system of claim 3, wherein said filtration device is removably affixed and cover the entire area of said inlet grate.

5. The storm water filtration system of claim 4, wherein said filtration device is used on a convex inlet grate.

6. The storm water filtration system of claim 4, further comprising a curb adjacent said inlet grate, wherein said filtration device is removably affixed to said inlet grate and said filtration device is further placed over a portion of said curb.

7. The storm water filtration system of claim 4, wherein said latex binding agent is the only binding agent present in said filtering portion.

8. A storm water filtration system comprising:

an inlet grate and a filtration device; said filtration device contacting a portion of said inlet grate;

said filtration device further comprising, a mat adapted to filter ground water, said mat having a top, a bottom, at least a side, and an upper filtering portion and a lower filtering portion, wherein said upper filtering portion has a density between 4.5 and 6 oz./ sq. ft and said lower filtering portion has a density between 3.0 and 4.5 oz./sq. ft, said upper and said lower filtering portions being made from randomly aligned fibers and a binding agent, whereby said upper filtering portion may be driven over by vehicle and maintain its function and whereby said filtration device may be cleaned and reused without removing said filtration device from said inlet grate.

9. The storm water filtration system of claim 8, wherein said randomly aligned fibers are made of natural fibers.

10. The storm water filtration system of claim 9, wherein said fibers are coir fibers.

11. The storm water filtration system of claim 10, wherein said binding agent is a latex binding agent.

12. The storm water filtration system of claim 11 wherein said upper filtering portion has a density between 4.75 and 5.5 oz./ sq. ft. and said lower filtering portion has a density between 3.25 and 4.0 oz./sq. ft.

13. The storm water filtration system of claim 12, wherein said filtration device is removably affixed to said inlet grate.

14. The storm water filtration system of claim 13, wherein said inlet grate and filtration device may be removed for cleaning as a single unit.

* * * * *